US010231292B2

(12) United States Patent
Kim et al.

(10) Patent No.: US 10,231,292 B2
(45) Date of Patent: Mar. 12, 2019

(54) COOKING APPARATUS AND CONTROLLING METHOD THEREOF

(71) Applicant: Samsung Electronics Co., Ltd., Suwon-si (KR)

(72) Inventors: Seung Hun Kim, Suwon-si (KR); Young Wook Woo, Incheon (KR); Gyu Sik Lim, Suwon-si (KR); Hong Man Chang, Hwaseong-si (KR)

(73) Assignee: SAMSUNG ELECTRONICS CO., LTD, Suwon-si (KR)

( * ) Notice: Subject to any disclaimer, the term of this patent is extended or adjusted under 35 U.S.C. 154(b) by 203 days.

(21) Appl. No.: 15/006,841

(22) Filed: Jan. 26, 2016

(65) Prior Publication Data

US 2016/0219653 A1 Jul. 28, 2016

(30) Foreign Application Priority Data

Jan. 27, 2015 (KR) ..... 10-2015-0013093

(51) Int. Cl.
*H05B 6/66* (2006.01)
*H05B 6/50* (2006.01)
(Continued)

(52) U.S. Cl.
CPC ..... *H05B 6/6497* (2013.01); *H05B 6/645* (2013.01); *H05B 6/6408* (2013.01);
(Continued)

(58) Field of Classification Search
CPC ..... H05B 6/642; H05B 6/6408; H05B 6/645; H05B 6/6402; H05B 6/6435;
(Continued)

(56) References Cited

U.S. PATENT DOCUMENTS 3,810,248 A * 5/1974 Risman ..... H05B 6/708 219/730
4,917,076 A * 4/1990 Nadolph ..... A47G 19/027 126/246

(Continued)

FOREIGN PATENT DOCUMENTS

CN 1430020 A 7/2003
EP 0478082 A1 4/1992

OTHER PUBLICATIONS

Communication pursuant to Article 94(3) EPC dated Mar. 14, 2017 corresponding to European Application No. EP 16152733.8.

(Continued)

*Primary Examiner* — Hung D Nguyen
(74) *Attorney, Agent, or Firm* — Staas & Halsey LLP

(57) ABSTRACT

Disclosed herein are a cooking apparatus and a controlling method thereof. The cooking apparatus according to one aspect of the present embodiment includes an input part configured to receive a plate warming mode command; a microwave heating part configured to radiate microwave to at least one plate disposed in a cooking chamber provided inside the cooking apparatus; and a control part configured to control at least one of an operation time of the microwave heating part and an intensity of the microwave radiated from the microwave heating part when the plate warming mode command is input.

17 Claims, 11 Drawing Sheets

(51) Int. Cl.
*H05B 6/64* (2006.01)
*H05B 6/68* (2006.01)

(52) U.S. Cl.
CPC ..... *H05B 6/6491* (2013.01); *H05B 6/68* (2013.01); *H05B 6/687* (2013.01)

(58) Field of Classification Search
CPC .. H05B 6/6438; H05B 6/6458; H05B 6/6473; H05B 6/6479; H05B 6/6491; H05B 6/6494; H05B 6/6497; H05B 6/68; H05B 6/686; H05B 6/687; H05B 6/688; H05B 6/705; H05B 6/72; H05B 6/7255
USPC ..... 219/702, 710, 725, 730, 756, 745, 753, 219/754, 708, 681, 704
See application file for complete search history.

(56) References Cited

U.S. PATENT DOCUMENTS 4,937,412 A 6/1990 Dobry
5,293,019 A * 3/1994 Lee ..... A23L 3/01 219/708
2003/0121913 A1 7/2003 Hayami et al.
2004/0232141 A1* 11/2004 Yamasaki ..... H05B 6/6479 219/682
2008/0277400 A1* 11/2008 Welsh ..... B65D 77/225 220/592.2
2009/0145420 A1 6/2009 Whitis
2014/0116267 A1 5/2014 Hochschild, Jr. et al.
2014/0227402 A1 8/2014 Tan et al.

OTHER PUBLICATIONS

Extended European Search Report for EP 16152733 dated Jun. 17, 2016.

Chinese Patent Office Action issued First Office Action in Chinese Patent Application No. 201610056102.4 dated Oct. 31, 2018 (17 total pages).

* cited by examiner

COOKING APPARATUS AND CONTROLLING METHOD THEREOF

RELATED APPLICATION(S)

This application claims the benefit of Korean Patent Application No. 10-2015-0013093, filed on Jan. 27, 2015 in the Korean Intellectual Property Office, the disclosure of which is incorporated herein by reference.

BACKGROUND

Embodiments of the present embodiment relate to a cooking apparatus which warms an object using at least one of microwave heating, grill heating and convection heating, and a controlling method thereof.

A microwave oven cooks foods by supplying a microwave into a cooking chamber. Some microwave ovens also include grill units to supply radiant heat, a convection unit to supply convection heat, and a microwave heating unit to supply a microwave, and radiate or heat the food using various methods. Microwave ovens also provide a function to automatically cook the food using various heating sources based on the food. That is, microwave ovens also provide functions that warm the food using microwave, roast the food using the grill unit, or cook the food using the convection unit.

SUMMARY

Therefore, it is an aspect of the present embodiment to provide a cooking apparatus.

Additional aspects of the embodiment will be set forth in part in the description which follows and, in part, will be obvious from the description, or may be learned by practice of the embodiment.

In accordance with one aspect of the present embodiment, a cooking apparatus includes a cooking chamber; an input part configured to receive a plate warming mode command; a microwave heating part configured to radiate a microwave to a plate disposed in the cooking chamber; and a control part configured to control at least one of an operation time of the microwave heating part and an intensity of the microwave radiated from the microwave heating part when the plate warming mode command is received.

The input part may receive a warming degree of the plate disposed in the cooking chamber.

The control part may warm the plate disposed in the cooking chamber by controlling an operation of the microwave heating part according to the operation time and the intensity of the microwave predetermined corresponding to the warming degree received at the input part.

The control part may warm the plate disposed in the cooking chamber by controlling the intensity of the microwave to be constant during the operation time, or adjusting the intensity of the microwave.

The control part may warm the plate disposed in the cooking chamber by adjusting the intensity of the microwave over time, or controlling the intensity of the microwave in a plurality of stages.

The cooking apparatus may further include a load container which is disposed above the plate disposed in the cooking chamber, and used to warm the plate disposed in the cooking chamber.

A liquid substance which is heated by absorbing the microwave radiated from the microwave heating part is accommodated in a body of the load container.

A lower surface of the load container may be designed to be spaced apart from the plate put under the load container in a predetermined distance.

The microwave heating part may warm the plate disposed in the cooking chamber using a liquid substance accommodated in a body of the load container as a load for absorbing the microwave.

The microwave heating part may sense a weight of the plate disposed in the cooking chamber, may grasp or estimate the plate disposed in the cooking chamber, and may determine a radiation time and an intensity of the microwave according to the estimation.

In accordance with another aspect of the present embodiment, a method for controlling a cooking apparatus includes receiving a plate warming mode command; receiving one of a first mode and a second mode distinguished according to a warming degree of a plate when the plate warming mode command is received; and controlling a radiation of a microwave according to an operation method predetermined corresponding to an input mode of the first mode and the second mode, and warming a plate disposed in a cooking chamber.

The warming may warm the plate disposed in the cooking chamber by controlling the radiation of the microwave according to an operation time and an intensity of the microwave predetermined corresponding to input one of the first mode and the second mode.

The warming may warm warms the plate disposed in the cooking chamber by constantly radiating an intensity of the microwave or adjusting the intensity of the microwave during a predetermined period of time.

The warming may warm the at least one plate disposed in the cooking chamber by adjusting the intensity of the microwave in a plurality of stages over time.

The warming may warm the plate disposed in the cooking chamber using a load container disposed above the plate disposed in the cooking chamber.

A liquid substance which is heated by absorbing the microwave that has been radiated is accommodated in a body of the load container.

A lower surface of the load container may be designed to be spaced apart from the plate put under the load container in a predetermined distance.

The warming may warm the plate disposed in the cooking chamber using the liquid substance accommodated in the body of the load container as a load which absorbs the microwave.

BRIEF DESCRIPTION OF THE DRAWINGS

These and/or other aspects of the embodiment will become apparent and more readily appreciated from the following description of the embodiments, taken in conjunction with the accompanying drawings of which.

DETAILED DESCRIPTION

Reference will now be made in detail to the embodiments of the present embodiment, examples of which are illustrated in the accompanying drawings.

Figure 3:
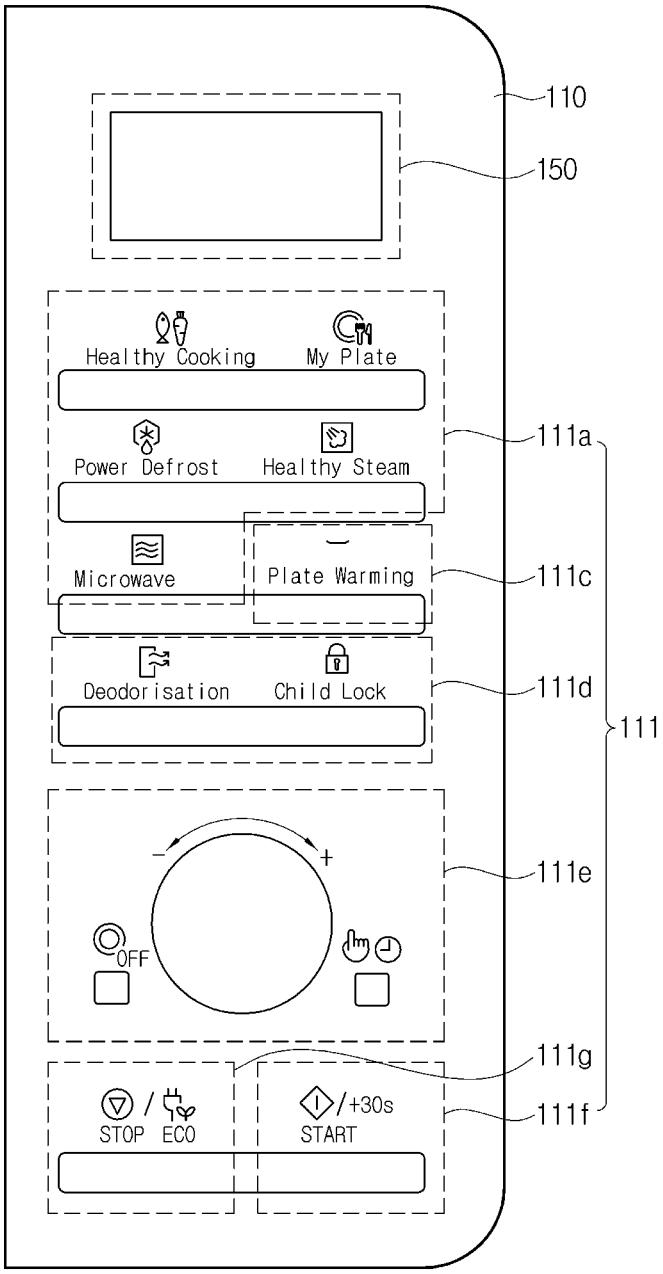
Figure 4:
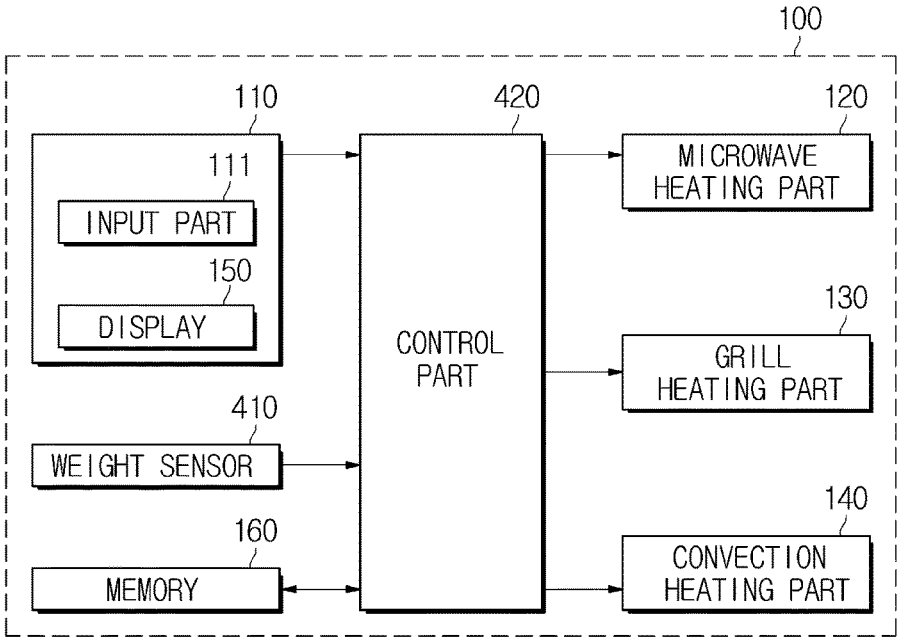
FIG. 4 is a view illustrating a control block diagram of the cooking apparatus according to one embodiment.
Figure 5:
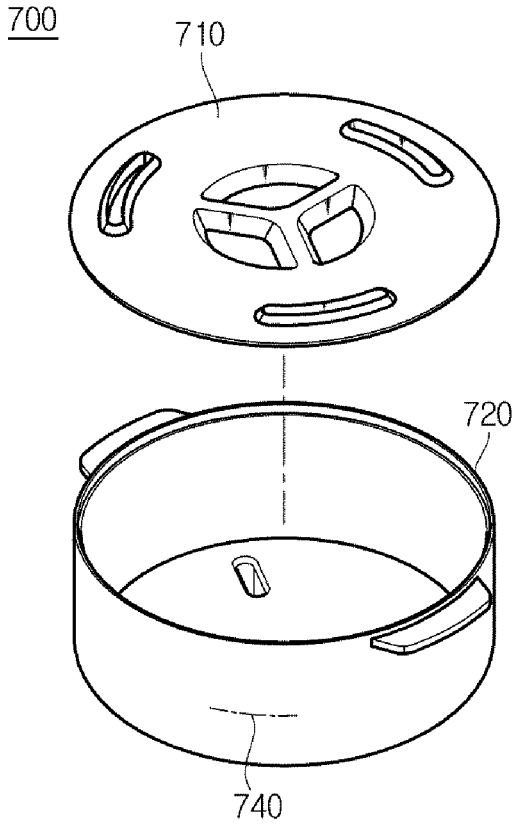
FIG. 5 is a view illustrating the load container which is divided into a cover and a body according to one embodiment.
Figure 6:
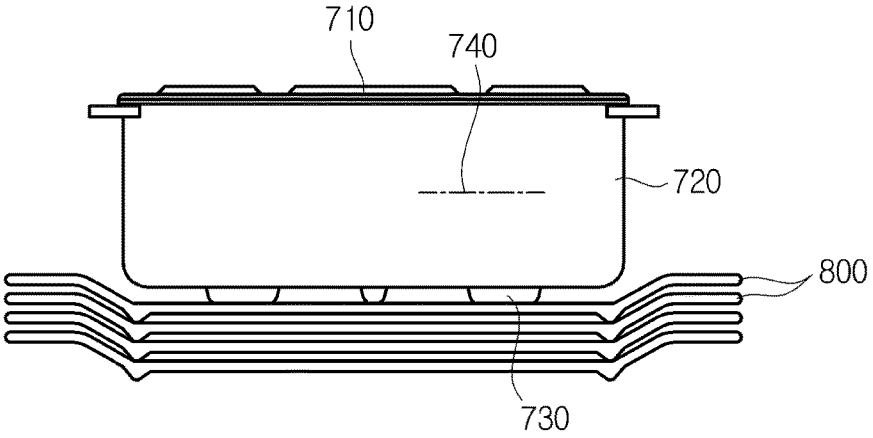
FIG. 6 is a view illustrating the load container which is disposed on a plurality of plates disposed inside the cooking apparatus to warm the plates according to one embodiment.

FIGS. 1 through 4 are views illustrating an interior and exterior of a cooking apparatus and a control block diagram thereof, and FIGS. 5 and 6 are views illustrating a plurality of plates 800 and a load container which are disposed inside the cooking apparatus.

Figure 1:
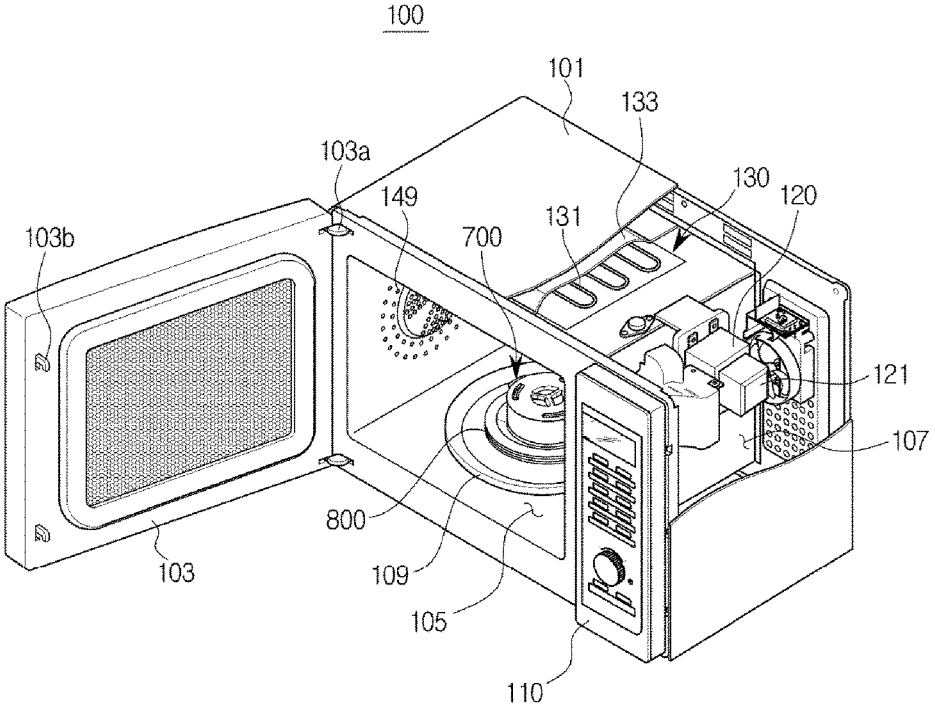
FIG. 1 is a view illustrating an exterior of a cooking apparatus in which a plate and a load container are disposed inside a cooking chamber according to one embodiment.

As illustrated in FIG. 1, a cooking apparatus 100 may include a main body 101 which forms an exterior thereof, a cooking chamber 105 which is provided inside the main body 101 to accommodate a food item or an object to be cooked, and a door 103 which is provided at a front surface of the main body 101 to open and close the cooking chamber 105. Also, the cooking apparatus 100 may include a machine chamber 107 which is provided at a right side of the cooking chamber 105 and in which a heating source such as a microwave heating part 120 is installed, and a turntable 109 on which the object is disposed. Meanwhile, although not illustrated in the drawings, a weight sensor which senses a weight of the object may be provided inside the cooking chamber 105. The cooking apparatus 100 may sense the weight of the object disposed inside the cooking chamber 105 using the weight sensor. Accordingly, the cooking apparatus 100 may control an output of elements, which radiate microwave or heat into the cooking apparatus 100, based on a sensed result. This will be described later.

An object which will be described below includes food and various containers, such as one of the plates 800, in which the food item is disposed. That is, the object includes all kinds of substances which may be warmed through the microwave or the heat radiated from an element in the cooking apparatus 100, and is not limited.

Meanwhile, referring to FIG. 1, the door 103 of the cooking apparatus 100 may be rotated through a hinge 103*a*. Also, the door 103 may be fixed through a latch 103*b* provided at an opposite side of the hinge 103*a*. According to one embodiment, as illustrated in FIG. 1, the door 103 may be rotatably installed at a left side of a front surface of the main body 101 through the hinge 103*a* so as to enable a user to open the door 103 with one hand and to easily take out the object in the cooking chamber 105 with other hand.

Also, the turntable 109 in which the object is disposed may be included inside the cooking chamber 105. As illustrated in FIG. 1, the turntable 109 may have a circular shape. The turntable 109 may be formed of glass, and may be rotated by a turntable motor (not shown). The turntable 109 is rotated by the turntable motor so that the microwave or the heat radiated from a heating source may be uniformly radiated to the entire object. As illustrated in FIG. 1, the plate 800 and a load container 700 may be placed on the turntable 109. This will be described later.

Meanwhile, as illustrated in FIG. 1, a control panel 110 including an input part 111 which receives an operation command of the cooking apparatus 100 from a user, and a display 150 which displays an operational state of the cooking apparatus 100 may be provided at a right side of the front surface of the cooking apparatus 100.

The input part 111 may receive the operation command, such as a cooking start, a cooking time, a cancellation and a pause of cooking and a warming mode, from the user. The input part 111 may be configured with a button type switch, a membrane switch, a dial or the like, but is not limited thereto.

Figure 2:
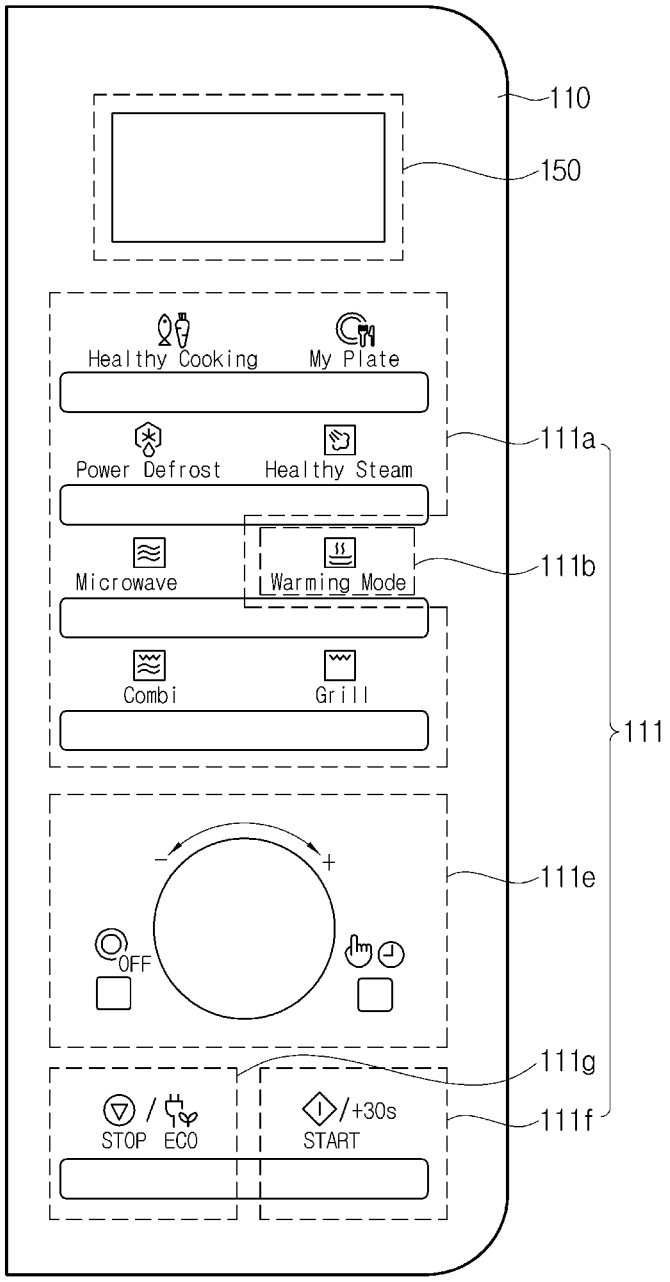
FIGS. 2 and 3 are views illustrating each control panel which is provided at a right side of a front surface of the cooking apparatus according to different embodiments from each other.

According to one embodiment, the input part 111 may be configured with various buttons and dials, as illustrated in FIG. 2. Referring to FIG. 2, the input part 111 may include function buttons 111*a* which select a heating method, an adjustable dial 111*e* which inputs a heating time or a weight of an object to be heated, a button 111*f* which inputs a driving or a "start" command of the cooking apparatus 100 or selects a certain command, a cancellation button 111*g* which inputs a stop command of the cooking apparatus 100, or cancels a selection of the certain command, and a warming mode button 111*b* which selects the warming mode.

When the user pushes the warming mode button 111*b*, the input part 111 may receive a warming mode command. The warming mode command is an operation command that activates a warming mode to warm the object. Also, the input part 111 also may receive a type of the object to be warmed and a warming degree of the object from the user.

As another example, as illustrated in FIG. 3, the input part 111 may include the function buttons 111*a* to select a heating method, buttons 111*d* to provide a deodorizing function, a protecting function or the like, the adjustable dial 111*e* to input the heating time or the weight of the object to be heated, the button 111*f* to input the driving command of the cooking apparatus 100 or select a certain command, the cancellation button 111*g* to input the operation stop command of the cooking apparatus 100, or cancel the selection of the certain command, and a button 111*c* to select a plate warming mode.

A plate warming mode command is an operation command that activates the plate warming mode to warm the plate 800. That is, the plate warming mode command is an operation command in which the object for the warming mode command may be limited to the plate 800. Therefore, when the user pushes the button 111*c* which selects the plate warming mode, the object of warming is limited to the plate 800, and thus the cooking apparatus 100 receives only the warming degree or a desired temperature through the input part 111. Thus, for activating the plate warming mode, separately receiving an input of the object to be warmed may be optional.

Meanwhile, a configuration of the input part 111 is not limited to FIGS. 2 and 3, and may include buttons which select various functions, or the like. For example, a button which selects a food warming mode may be separately provided at the input part 111, and there is no limitation. The food warming mode is a mode that initiates a food warming process to keep a temperature of food.

Since the input part 111 according to the disclosed embodiment has the button 111*b* which selects the warming mode or the button 111*c* which selects the plate warming mode, the user may easily activate either the warming mode or the plate warming mode.

Further, referring to FIGS. 2 and 3, the display 150 may be provided at an upper portion of the control panel 110. The display 150 may include a liquid crystal display (LCD), a light emitting diode (LED), a plasma display panel (PDP), an organic light emitting diode (OLED) and so on. However, the display 150 is not limited thereto, and may be realized with various devices.

Meanwhile, when the display 150 is a touchscreen, the display 150 may also activate a function of the input part 111. That is, in the control panel 110 illustrated in FIGS. 2 and 3, the input part 111 and the display 150 are separately provided, but the control panel 110 is not limited thereto.

An operational state such as an output of the cooking apparatus 100 and the cooking time may be displayed on the display 150. Also, a variety of other information may be displayed on the display 150. According to one embodiment, when the user pushes the warming mode button 111*b* to select the warming mode illustrated in FIG. 2, an interface to select a type of the object to be warmed through the warming mode may also be displayed on the display 150.

According to one embodiment, when the user pushes or touches the warming mode button 111*b* to select the warming mode as illustrated in FIG. 2, the plate 800 and the food item as the object to be warmed through the warming mode may be displayed on the display 150. Therefore, the user may select one of the 'plate 800' and the 'food' through the input part 111 or the display 150. Also, an interface for selecting the warming degree or a desired temperature may be displayed and/or selected on the display 150.

According to one embodiment, terms 'hot' and 'mild' indicating the warming degree may be displayed on the display 150. The terms 'hot' and 'mild' indicate the warming degree, and a temperature corresponding to each of the terms is predetermined. In general, the term 'hot' may be predetermined to a temperature at which the user feels that the object is hot, and the term 'mild' may be predetermined to a temperature at which the user feels that the object is warm.

In some cases, a hot level is generally relatively for different users. That is, a hot level for a user may be a mild level for another. Therefore, the temperature corresponding to each of the terms 'hot' and 'mild' may be set equally or differently according to the object. For example, in the case of the plate 800, the term 'hot' may be set to a temperature of 60° C., and the term 'mild' may be set to a temperature of 40° C. In the case of a food item, the term 'hot' may be set to a temperature of 70° C., and the term 'mild' may be set to a temperature of 50° C.

Also, an operation method of the cooking apparatus 100 corresponding to each of the terms 'hot' and 'mild' is set in advance, and thus the object may be warmed corresponding to the term 'hot' or 'mild' by controlling an operation of the heating source according to the predetermined operation method. A detailed description thereof will be provided later.

As another example, when the user pushes the button 111*c* which selects the plate warming mode illustrated in FIG. 3, the interface which enables to select the desired temperature or the warming degree may be displayed on the display 150. According to one embodiment, the terms 'hot' and 'mild' as the warming degree may be displayed on the display 150, as described above.

Accordingly, the user may select one of the terms 'hot' and 'mild' through the input part 111 or the display 150 realized in the touchscreen type. When the user selects one of the terms 'hot' and 'mild,' the cooking apparatus 100 may control the microwave heating part 120 according to the predetermined operation method corresponding to the selected warming degree, and thus may warm the plate 800. That is, the user inputs only the warming degree, and does not need to separately set the operation method of the cooking apparatus 100. Therefore, the user may easily warm the plate 800 using the cooking apparatus 100.

The cooking apparatus 100 may operate or activate at least one of the heating sources, such as the microwave heating part 120 to radiate the microwave, a grill heating part 130 to radiate radiant heat, and a convection heating part 140, according to the selected object. That is, the cooking apparatus 100 may operate or activate at least of the heating sources according to a selected one of the warming mode for food and the plate warming mode. Hereinafter, the microwave heating part 120 that radiates the microwave as the plate warming mode is performed will be described.

Referring to FIG. 1, the microwave heating part 120 includes a magnetron 121 which is provided at the machine chamber 107 located at the right side of the cooking chamber 105, and generates the microwave radiated into the cooking chamber 105, and a high voltage transformer (not shown) which applies a high voltage to the magnetron 121.

The microwave heating part 120 may heat the object located inside the cooking chamber 105 by radiating the microwave into the cooking chamber 105 through a right inner wall of the cooking chamber 105. At this time, the microwave radiated by the microwave heating part 120 may penetrate the object, and may heat even an inside of the object.

The microwave heating part 120 may be realized with various elements. For example, the microwave heating part 120 may be realized with a fixed output microwave heating part which outputs the microwave at a maximum output power. The fixed output microwave heating part may radiate the microwave having a variety of power by controlling a ratio between a time while the microwave is radiated and a time while the microwave is not radiated. As another example, the microwave heating part 120 may be realized with a variable output microwave heating part which radiates the microwave having a variety of intensity using an inverter.

Therefore, the microwave heating part 120 may radiate the microwave having a constant intensity or an adjusted intensity, while being operated. Also, the microwave heating part 120 may adjust the intensity of the microwave in a plurality of stages, and then may radiate the adjusted microwave, and may also radiate the microwave according to various operation methods such as adjusting of the intensity of the microwave over time.

For example, when it is intended that the plate 800 is warmed to a low temperature, the microwave heating part 120 may warm the plate 800 by radiating the microwave having the constant intensity for a short period of time. As another example, when it is intended that the plate 800 is warmed to a high temperature, the microwave heating part 120 may warm the plate 800 by adjusting the intensity of the microwave, but the present embodiment is not limited thereto.

For example, the microwave heating part 120 may warm the plate 800 to a temperature between, for example, 30 and 70° C. by radiating the microwave for, for example, between 1 and 11 minutes. However, an operation of the microwave heating part 120 is not limited thereto, and the microwave heating part 120 may warm the plate 800 to a temperature between, for example, 40 and 60° C. by radiating the microwave for, for example, between 2 to 10 minutes. At this time, a maximum output and a variable range of the output of the microwave heating part 120 may be different according to different embodiments. Therefore, an operation time and an intensity of the output depending on the warming degree may be predetermined according to a specification of the microwave heating part 120, the specification being stored in a memory 160.

According to one embodiment, the microwave heating part 120 may warm the plate 800 to a temperature of 40° C. by radiating the microwave having an intensity of 800 W for 2 minutes. In another embodiment, the microwave heating part 120 may warm the plate 800 to a temperature of 60° C. by radiating the microwave having an intensity of 900 W for 5 minutes.

In still another embodiment, the microwave heating part 120 may warm the plate 800 to a temperature of 60° C. by radiating the microwave having an intensity of 850 W for 4 minutes and 30 seconds and then radiating the microwave having a different intensity of 450 W for one minute and 30 seconds.

Accordingly, when the warming mode is finished, the plate 800 may have a temperature corresponding to the warming degree input by the user. At this time, a temperature of the plate 800 may be continuously increased while the warming mode is being performed, and then may reach the temperature corresponding to the warming degree when the warming mode is finished. Alternatively, the plate 800 may be warmed to a temperature higher than that of the warming degree input by the user, and then the temperature of the plate 800 may be gradually lowered and may reach the temperature corresponding to the warming degree input by the user when the warming mode is finished. That is, the microwave heating part 120 may warm the plate 800 by radiating the microwave in various methods and/or intensities and/or times.

Meanwhile, the operation method of the microwave heating part 120 may be predetermined according to the warming degree, and then may be stored in the memory 160. For example, the operation method such as the intensity of the microwave radiated from the microwave heating part 120 and the operation time of the microwave heating part 120 may be predetermined according to the desired temperature and the warming degree, and then may be stored in the memory 160. That is, an algorithm in which the operation method of the microwave heating part 120 is set so as to properly warm the plate 800 via a radiated microwave may be stored in the memory 160. Therefore, the user may warm various kinds of dishes such as the plate related to the object to be cooked, as well as the food item corresponding to the object to be cooked. At this time, since the operation method is predetermined in the memory 160, the user may be easily provided with the warmed dishes just by inputting the warming degree. Accordingly, the cooking apparatus 100 enables the user to be easily provided with the warmed dishes using the warming mode.

In addition, an algorithm in which the operation method of the microwave heating part 120 is set according to the temperature may be stored in the memory 160. Therefore, when the desired temperature is directly input by the user, the microwave heating part 120 may warm the plate 800 by radiating the microwave based on the predetermined operation method according to the corresponding desired temperature.

The user may place the food on the plate 800 warmed by the cooking apparatus 100. Accordingly, a temperature of the food may be maintained for a longer period of time, and thus the user may have warmer food.

Meanwhile, in the cooking apparatus 100 according to one embodiment, a load container which absorbs the microwave when the microwave is radiated so as to warm the plate 800 and is used as a load may be disposed above the plate 800. The load container which will be described below is a container which is used as the load for absorbing the microwave.

Referring to FIG. 5, the load container 700 may be formed with a cover 710 and a body 720. The cover 710 and the body 720 may be separated from each other. Therefore, the user may separate the cover 710 from the body 720, and may pour a liquid substance into the body 720.

The liquid substance which will be described below is a liquid which absorbs the microwave and is changed into a gas when exceeding a certain temperature. The certain temperature may be changed according to the liquid substance. The liquid substance includes water which is evaporated into vapor. However, the liquid substance is not limited thereto, but may include all of liquids which absorb a microwave and are changed into gases. Meanwhile, when the liquid substance disposed in the body 720 absorbs the microwave and is changed into a gas, the gas may be taken out of the body 720 through an opening formed at the cover 710.

Referring to FIG. 6, the load container may be disposed above the stacked plates 800. Therefore, the microwave radiated into the cooking chamber 105 through the microwave heating part 120 may be absorbed into the load container as well as the plates 800. Meanwhile, as illustrated in FIG. 6, the cooking apparatus 100 may warm the plates 800 having various sizes as well as the plates 800 having the same size.

Referring to FIG. 6, a protruding portion 730 which protrudes convexly to prevent the body 720 from being in close contact with the plate 800 may be provided at a lower surface of the body 720. The load container 700 may be spaced apart from the plate 800 located at a lower side thereof in a predetermined distance by the protruding portion 730, and may be used as only a load which does not transfer the heat generated by the microwave to the plate 800 and absorbs the microwave. The distance which is spaced apart from the plate 800 may be determined according to a height of the protruding portion 730 of the load container 700, and the height of the protruding portion 730 may be predetermined when the load container 700 is designed.

The load container 700 may be formed of a material which is hardly affected by the microwave. For example, the load container 700 may be formed of polypropylene (PP) or the like, but is not limited thereto. Meanwhile, a scale mark 740 may be provided at a side surface of the body 720. The user may put the liquid substance corresponding to the scale mark 740. The scale mark 740 may be predetermined by a designer or a manufacturer, when the load container 700 is designed. The scale mark 740 may be set so that the liquid substance absorbs the microwave during an operation time of the microwave heating part 120, when the load container 700 is designed. For example, the scale mark 740 may be indicated to accommodate the liquid of 200 ml, but is not limited thereto.

According to one embodiment, the microwave heating part 120 may warm the plates 800 stacked beneath the load container 700, which holds an amount of water, to a temperature of 60° C. At this time, the microwave heating part 120 may warm the plate 800 to a temperature of 60° C. within 5 minutes using the microwave.

The load container 700 may absorb the microwave radiated from the microwave heating part 120 through the liquid substance, and thus may prevent the microwave from being excessively radiated to the plate 800. Also, as illustrated in the drawings, the load container 700 may be designed to be spaced apart from the plate 800 in a predetermined distance.

Accordingly, the heat absorbed by the load container 700 may be prevented from being absorbed by the plate 800. The predetermined distance may be set by the manufacturer when the load container 700 is designed.

Meanwhile, the plate 800 which is warmed by the plate warming mode may be formed of a material which absorbs the microwave and radiates heat. Also, the plate 800 may be formed a material which is safe from the microwave, i.e., a microwave safe material.

Meanwhile, the microwave heating part 120 may warm the plates 800 having various sizes, and the size of the plate 800 is not limited. Also, referring to FIG. 1, all of the plates 800 are formed in circular shapes, but are not limited thereto. The shape of the plate 800 which may be warmed by the microwave heating part 120 is not limited.

According to one embodiment, the output of the microwave and the operation time of the microwave heating part 120 according to the corresponding output may be set in advance. That is, the intensity of the output of the microwave heating part 120 and the operation time of the microwave heating part 120 may be predetermined in the form of an algorithm corresponding to the temperature to which the plate 800 is intended to be warmed, and then may be stored in the memory 160.

As another example, the microwave heating part 120 may sense the weight of the plates 800 disposed in the cooking chamber 105 through the weight sensor, and may estimate a number of the plates 800 or the like based on a sensed result. Therefore, the microwave heating part 120 may determine a radiation time of the microwave in proportion to the estimation. That is, the microwave heating part 120 may set the operation time of the microwave heating part 120 according to the sensed result. A method of estimating the number of plates 800 based on the sensed result, and a method of determining the operation time of the microwave based on the estimation may be programmed through an algorithm, and then may be stored in the memory 160.

The cooking apparatus 100 according to one embodiment may use the load container 700 as a load to absorb the microwave, and thus may prevent a damage of the plate 800 due to a direct radiation of the microwave having a high output to the plate 800, and may also prevent a damage of the interior of the cooking chamber 105. Hereinafter, the grill heating part 130 and the convection heating part 140 which are operated to perform the warming mode for the food item will be described.

Referring to FIG. 1, the grill heating part 130 may include a grill heater 131 at an upper side of the cooking chamber 105 to generate or radiate radiant heat, and a reflector 133 to concentrate the radiated radiant heat within the interior of the cooking chamber 105. The grill heater 131 may include a halogen lamp to radiate intense radiant heat, a heating wire to radiate Joule heat through electric resistance, and the like.

The radiant heat radiated by the grill heater 131 may be radiated directly into the cooking chamber 105 or may be reflected by the reflector 133 and then may be radiated into the cooking chamber 105, and thus may heat the object located inside the cooking chamber 105.

When the food warming mode command is input by the user, the grill heating part 130 may operate the grill heater 131, and may warm the food item. The grill heating part 130 may heat the food item so that the temperature and/or the warming degree input by the user are maintained. The temperature or the warming degree input by the user may be lower than a temperature when the food item is cooked. That is, the grill heating part 130 may heat the food so that the food item is maintained at a temperature lower than the temperature when the food item is cooked. For example, the grill heating part 130 may heat the food item so that the food item is maintained at a temperature between 50° C. and 70° C. Therefore, the grill heating part 130 may keep water contained in the food item as much as possible, and may also keep texture of the food item, even though a certain period of time elapses after cooking is completed.

The grill heating part 130 may warm the food item by controlling an operation of the grill heater 131 while the warming mode is performed. For example, the grill heating part 130 may control a temperature for warming the food item by controlling an operation period of the grill heater 131. According to one embodiment, the grill heating part 130 may periodically repeat an ON/OFF operation of the grill heater 131 during a period of time while the warming mode is performed.

At this time, the grill heating part 130 may control the operation period, i.e., an ON/OFF period of the grill heater 131 according to the desired temperature or the warming degree input by the user, and thus may supply the radiant heat so that an average temperature in the cooking chamber 105 is maintained lower than the temperature when the food is cooked. For example, when the desired temperature is set to 70° C., the grill heating part 130 may periodically repeat an operation, for 60 minutes while the food warming mode is activated, in which the grill heater 131 is turned on for 20 seconds and then turned off for one minute, and thus may maintain the average temperature of the food item at 70° C.

Meanwhile, referring to FIG. 1, the cooking apparatus 100 may include the convection heating part 140 to supply hot wind into the cooking chamber 105, as well as the microwave heating part 120 and the grill heating part 130. The cooking apparatus 100 may warm the food item using the convection heating part 140 as well as the grill heating part 130. Hereinafter, the convection heating part 140 will be described.

Referring to FIG. 1, the convection heating part 140 includes a convection heater (not shown) on an left wall of the cooking chamber 105 to generate the hot wind for heating the object, a convection circulation fan (not shown) to supply air heated around the convection heater into the cooking chamber 105, and a convection driving motor (not shown) to drive the convection circulation fan.

A circulation fan accommodating chamber may be provided at the left wall of the cooking chamber 105 to be recessed in a predetermined depth. At this time, the convection heater and the convection circulation fan are provided at an inner surface of the circulation fan accommodating chamber, and the convection driving motor may be provided at an outer surface of the circulation fan accommodating chamber.

The convection circulation fan draws internal air of the cooking chamber 105 into the circulation fan accommodating chamber by rotation of a blade, and re-circulates the internal air in a radial direction thereof. The convection heater may be provided along an outside of the convection circulation fan so as to surround the convection circulation fan, and may heat the air blown by the convection circulation fan.

Also, a fan cover which divides the circulation fan accommodating chamber and the cooking chamber 105 may be installed between the circulation fan accommodating chamber and the cooking chamber 105. A plurality of inlet openings through which the internal air of the cooking chamber 105 is introduced into the circulation fan accommodating chamber may be provided at a center portion of the fan cover, and a plurality of outlet openings through which the air heated in the circulation fan accommodating chamber is discharged into the cooking chamber 105 may be provided at an outer portion of the fan cover.

The convection circulation fan draws the internal air of the cooking chamber 105 through the inlet openings, and blows the air in the radial direction. The convection heater heats the air blown by the convection circulation fan, and the air heated by the convection heater is provided into the cooking chamber 105 through the outlet openings 149, and thus may warm the food.

Meanwhile, a variety of data related to the operation method of the cooking apparatus 100 may be stored in the memory 160. As described above, various algorithms related to the operation method of the microwave heating part 120, the grill heating part 130 and the convection heating part 140 according to the warming mode and the desired temperature or the warming degree may be programmed and stored in the memory 160. Therefore, according to the warming degree input by the user, the cooking apparatus 100 may control the operation of the heating source such as the microwave heating part 120, the grill heating part 130 and the convection heating part 140, and may automatically warm the plates 800 or the food item. It should be noted that, although a number of plates 800 are shown in FIG. 6, there may be one or more plates 800 in other embodiments.

The memory 160 may include a card type memory card such as a secure digital (SD) card and a solid state drive (SSD) card as well as a random access memory (RAM), a read only memory (ROM), and a flash memory, but is not limited thereto.

Also, referring to FIG. 4, the cooking apparatus 100 may include the control panel 110 that includes the display 150 and the input part 111, the microwave heating part 120, the grill heating part 130, the convection heating part 140, the weight sensor 410, the memory 160, and a control part 420.

The control part 420 may control some or all of the operations of the cooking apparatus 100. Specifically, the control part 420 may control the operation of various modules built in the cooking apparatus 100 and some or all of the display 150, the input part 111, the microwave heating part 120, the grill heating part 130, the convection heating part 140, the weight sensor 410, the memory 160, and the like. According to one embodiment, the control part 420 may include a processor or a controller, and may generate a control signal for controlling the cooking apparatus 100, and may control the operation thereof using the control signal.

According to one embodiment, the control part 420 may cause a warming of the object by controlling at least one of the microwave heating part 120, the grill heating part 130 and the convection heating part 140 according to the warming mode command input through the input part 111. At this time, the control part 420 may warm the object by controlling the output and the operation time of the microwave heating part 120, the grill heating part 130 and the convection heating part 140 using the algorithm stored in the memory 160. Hereinafter, a sequence of the operation in the warming mode of the cooking apparatus 100 will be described.

Figure 7:
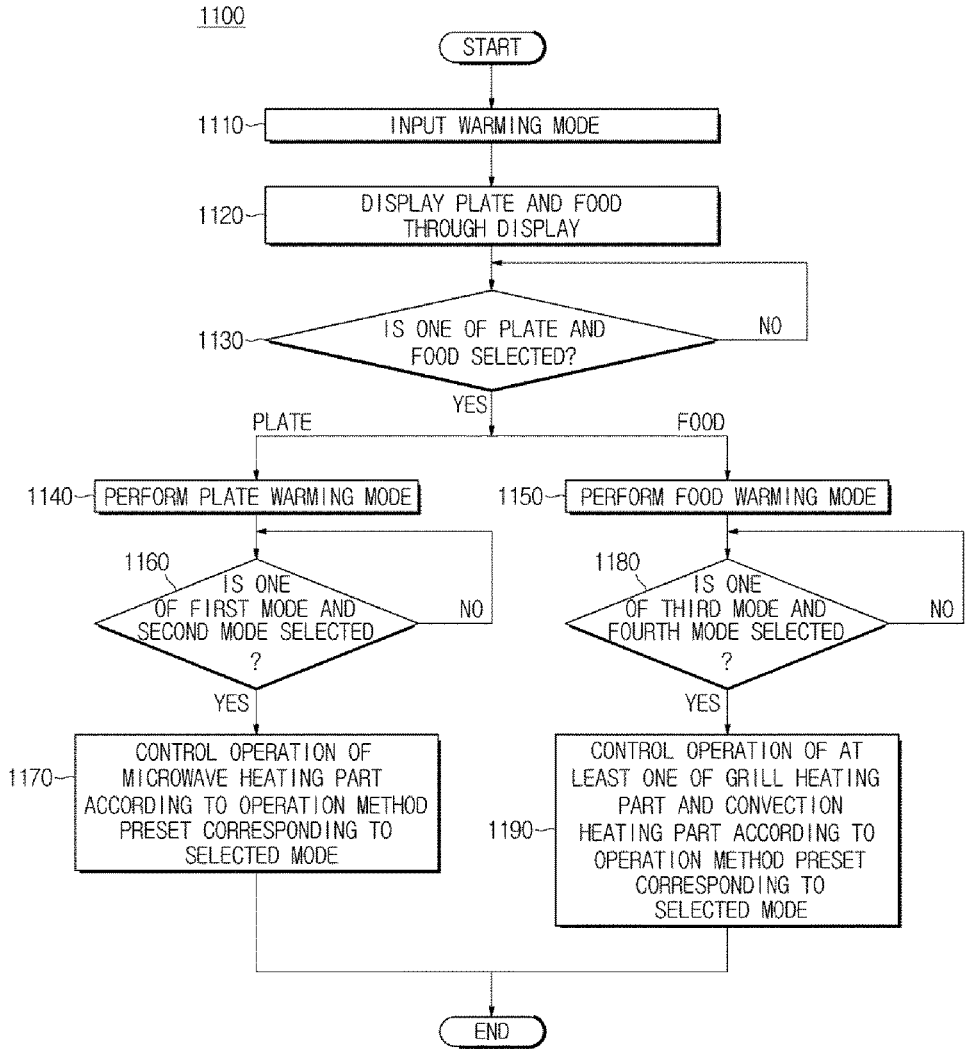
FIG. 7 is a view illustrating a flowchart in a warming mode of the cooking apparatus according to one embodiment.

FIG. 7 is a view illustrating a flowchart of a warming process 1100 in a warming mode of the cooking apparatus 100 according to one embodiment.

The cooking apparatus 100 may receive various control commands related to the cooking apparatus 100 from a user through the control panel 110. According to one embodiment, the cooking apparatus 100 may receive the warming mode command from user through the control panel 110 at block 1110. At this time, the cooking apparatus 100 may receive the warming mode command through the button or switch provided at the control panel 110, or may receive the warming mode command through the display 150, which may include a touchscreen.

When the warming mode command is received, the cooking apparatus 100 may display the objects which may be warmed by the warming process 1100 in the warming mode through the display 150 of the control panel 110, and thus may guide a selection of the object. For example, the cooking apparatus 100 may display the objects such as 'plate' or 'food' at block 1120. Accordingly, the user may select 'plate' or 'food' through the input part 111, or may select 'plate' or 'food' through the display 150 at block 1130.

In addition, as illustrated in FIG. 3, the cooking apparatus 100 may receive the warming mode command, in which the object is specified as the 'plate,' through the button 111*c* which selects the plate warming mode. That is, when the user selects the 'plate' through the input part 111 or the display 150, which may be a touchscreen, or pushes the button 111*c* to select the plate warming mode, the cooking apparatus 100 may activate or initiate the plate warming mode at block 1140. When the button 111*c* to select the plate warming mode is pushed, the cooking apparatus 100 may skip block 1120 of displaying the objects of the warming mode and the block 1130 of selecting the object based on block 1120.

Also, although not illustrated in the drawings, the cooking apparatus 100 may have a button that selects the warming mode. Therefore, when the user selects 'food' through the input part 111 or the display 150, or pushes the button to select the warming mode, the cooking apparatus 100 may perform the food warming mode at block 1150. When the button which selects the food warming mode is pushed, the cooking apparatus 100 may also skip block 1120 of displaying the objects of the warming mode and block 1130 of selecting the object based on block 1120, as described above.

Operations the cooking apparatus 100 may be different based on whether the plate warming mode or the warming mode for food is selected. Therefore, hereinafter, a case in which the user selects 'plate' and thus the plate warming mode is activated, and a case in which the user selects 'food' and thus the food warming mode is activated will be separately described. First, when the user selects 'plate,' the cooking apparatus 100 may request a selection of one of a first mode and a second mode at block 1160.

Each of the first mode and the second mode is an operation mode which is set according to the warming degree, and an operation method including the operation time of the microwave heating part 120 and the intensity of the output of the microwave heating part 120 according to each of the first and second modes is set in advance. Accordingly, when the user just selects a particular mode, the cooking apparatus 100 may radiate the microwave according to the selected particular mode, and may warm the plate without additional inputs or operations.

For example, the cooking apparatus 100 may indicate the first mode as the term 'hot' and the second mode as the term 'mild' through the display 150. The term 'hot' may be a temperature at which the user feels hot when touching the plates 800, and may be set to 60° C., but is not limited thereto. Also, the term 'mild' may be a temperature at which the user feels warm when touching the plates 800, and may be set to 40° C., but is not limited thereto.

At block 1170, the cooking apparatus 100 may warm the plate by controlling the operation of the microwave heating part 120 according to the selected first mode or the second mode. That is, the cooking apparatus 100 according to one embodiment may heat the object to be cooked such as the food item, and may also provide the warming mode for various kinds of dishes related to the object to be cooked. At this time, since the operation method related to the warming mode is set in advance, the cooking apparatus 100 enables the user to be easily provided with the dishes warmed through the warming mode.

Figure 8A:
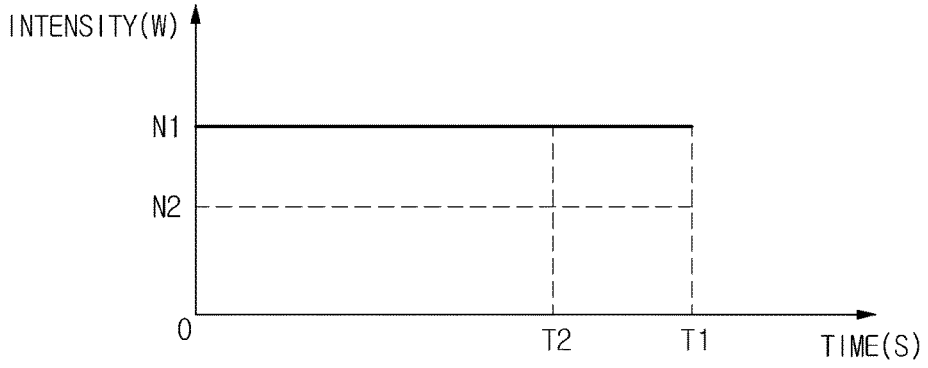
FIGS. 8A and 8B are views illustrating an intensity of microwave radiated over time while a plate warming mode is performed according to one embodiment.

At this time, the cooking apparatus 100 may warm the dishes by controlling the operation of the microwave heating part 120 according to various operation methods. For example, the cooking apparatus 100 may warm the dishes by constantly radiating the intensity of the microwave during the operation time. As illustrated in FIG. 8A, the cooking apparatus 100 may radiate the microwave having an intensity corresponding to N1 Watts (W), $N1 \geq 0$, during a time T1, $T1 \geq 0$. Generally, T1 may be set to 1 minute to 10 minutes, and N1 may be set to 800 W to 1000 W, but they are not limited thereto.

Figure 8B:
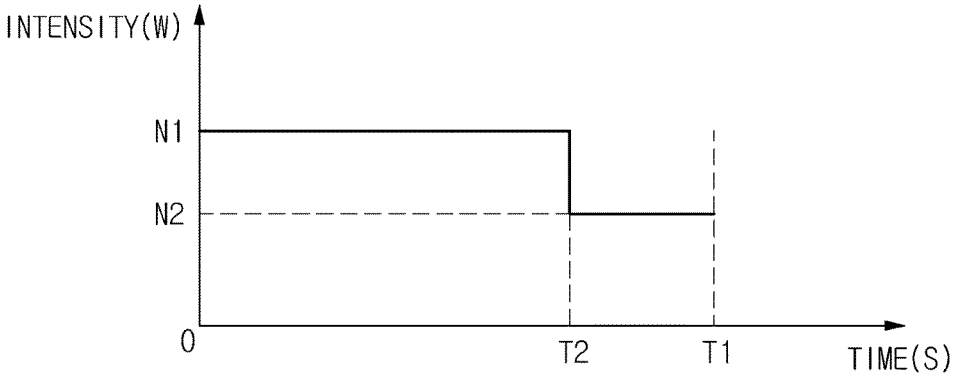

As another example, the cooking apparatus 100 may adjust the intensity of the microwave, and then may radiate the microwave having the adjusted intensity during a time while the warming mode is performed. Referring to FIG. 8B, the cooking apparatus 100 may radiate the microwave having the intensity corresponding to N1 W during a time T2, $T1 \geq T2 \geq 0$, and may radiate the microwave having an intensity corresponding to N2 W, $N1 \geq N2 \geq 0$, during a time from T2 to T1. According to one embodiment, among 2 minutes and 30 seconds while the warming mode is performed, the cooking apparatus 100 may radiate the microwave having an output of 1000 W for 2 minutes, and may radiate the microwave having an output of 500 W for the remaining 30 seconds. Meanwhile, N2 may be generally set to 400 W to 500 W, but is not limited thereto.

In addition, the cooking apparatus 100 may directly receive the desired temperature from the user using the adjustable dial 111*e* illustrated in FIGS. 2 and 3. Also, the cooking apparatus 100 may directly receive the desired temperature through various buttons or switches, the display 150 realized in the touchscreen type or the like.

At this time, the cooking apparatus 100 may set the operation method of the microwave heating part 120, which warms the plate to a corresponding temperature, according to the temperature in advance. For example, when a temperature of 50° C. is input by the user, the cooking apparatus 100 may control the microwave heating part 120 according to the intensity of the microwave and the time predetermined corresponding to the temperature of 50° C., and thus may perform a process for warming the plate to 50° C.

Hereinafter, a case in which the food warming mode is performed in the operation 1150 will be described. The cooking apparatus 100 may request a selection of one of a third mode and a fourth mode at block 1180.

Each of the third mode and the fourth mode is an operation mode which is set according to the warming degree, and an operation method including the operation time and the operation period of at least one of the grill heating part 130 and the convection heating part 140 according to each of the third and fourth modes is set in advance.

For example, the cooking apparatus 100 may indicate the first mode as the term 'hot' and the second mode as the term 'mild' through the display 150. The term 'hot' may be a temperature at which the user feels that the food is hot, and may be set to 70° C., but is not limited thereto. Also, the term 'mild' may be a temperature at which the user feels that the food is warm, and may be set to 50° C., but is not limited thereto. Here, the temperature of the first mode may be the same as that of the third mode, and the temperature of the second mode may be the same as that of the fourth mode. However, since the objects which are the plate and the food are different from each other, the temperature at which the user feels hot or warm may be different. Therefore, in the display 150, the first mode and the third mode may be equally indicated as the term 'hot,' and the second mode and the fourth mode may be equally indicated as the term 'mild,' but the temperature corresponding to each mode may be different.

The cooking apparatus 100 may warm the food by controlling at least one of the grill heating part 130 and the convection heating part 140 based on the operation method predetermined according to the first mode or the second mode at block 1190.

For example, an operation period of the grill heater 131 or the convection heater, a performing time of the warming mode or the like may be programmed according to the warming degree or the desired temperature, and then may be stored in the memory 160. Therefore, the cooking apparatus 100 may control the operation of the grill heating part 130 or the convection heating part 140 based on those stored in the memory 160, may control the heat supplied into the cooking chamber 105, and thus may warm the food according to the mode selected by the user.

According to one embodiment, as illustrated in FIG. 9, the cooking apparatus 100 may warm the food by repeating a process of operating the grill heating part 130 and supplying the radiant heat and a process of stopping the operation of the grill heating part 130 during the operation time. At this time, the cooking apparatus 100 may control the temperature in the cooking chamber 105 by controlling the operation time, or may control the temperature in the cooking chamber 105 by controlling the operation period of the grill heating part 130.

Figure 9A:
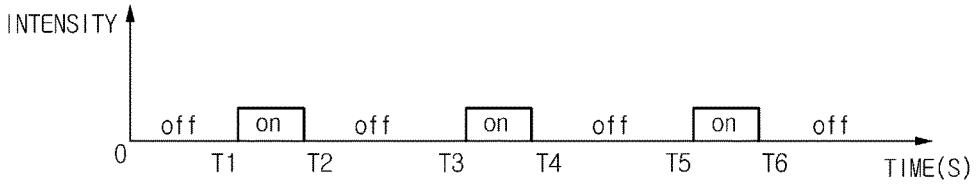
FIGS. 9A and 9B are views illustrating an operating cycle of a grill heating part while a food warming mode is performed according to one embodiment.
Figure 9B:
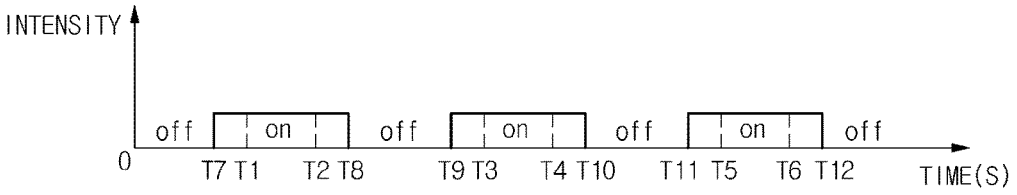

That is, the cooking apparatus 100 may warm the food according to the desired temperature input by the user by controlling an ON/OFF period of the grill heating part 130. Specifically, during the same time, the operation time T1-T2, T3-T4 and T5-T6 of the grill heating part 130 in FIG. 9A is shorter than the operation time T7-T8, T9-T10 and T11-T12 of the grill heating part 130 in FIG. 9B. That is, the cooking apparatus 100 may make the operation time of the warming mode longer, and thus may increase the temperature for warming the food, or may make the actual operation time of the grill heating part 130 longer, and thus may increase the temperature for warming the food. The operation period of the grill heating part 130 and the operation time of the warming mode according to the desired temperature may be set in advance, and then may be stored in the memory 160 of the cooking apparatus 100.

According to one embodiment, to maintain the temperature of the food at 70° C., the cooking apparatus 100 may perform the food warming mode for 60 minutes. At this time, the cooking apparatus 100 may maintain the temperature of the food at 70° C. by periodically repeating for 60 minutes an operation in which the grill heater 131 is turned on for 20 seconds and then turned off for 1 minute. As another example, the cooking apparatus 100 may maintain the temperature of the food item at 50° C. by periodically repeating for 60 minutes an operation in which the grill heater 131 is turned on for 15 seconds and then turned off for 1 minute. However, the present embodiment is not limited thereto.

Meanwhile, it may not be intended that the temperature of the food item is maintained at 70° C. or 50° C. only when the operation time is finished. The cooking apparatus 100 may periodically repeat the operation period of the grill heater 131, and thus may warm the food item so that the temperature of the food is maintained at 70° C. or 50° C. on average. That is, even when the user finishes the warming mode while the warming mode is being performed, the temperature of the food item may be maintained at 70° C. or 50° C. For example, assuming that the operation time of the food warming mode is 60 minutes, the temperature of the food may be maintained at 70° C. or 50° C. according to the input warming degree, even when the food warming mode is finished at 40 minutes of the operation time. That is, the operation time in the food warming mode is a time for maintaining the temperature of the food item, but not a time which is determined to set the temperature of the food when the operation time is finished.

Meanwhile, the food warming mode is not limited to 70° C. or 50° C., and may be set to a temperature which maintains N % (about 70 to 80%) of a temperature of the food when the food is cooked, or a temperature which is lower than the temperature of the food item, when the food item is cooked, by about 10° C., but is not limited thereto.

The method according to the embodiment may be realized in the form of a program command which is performed by means of various computers, and then may be recorded on a computer readable medium. The computer readable medium may include the program command, a data file, a data structure, and a combination thereof. The program command recorded on the medium may be specially designed and produced or may be an existing program command which is already well-known to a person skilled in the area of computer software. The computer-readable recording medium includes a magnetic medium such as a hard disk, a floppy disk and a magnetic tape, an optical medium such as a CD-ROM and a DVD, a magneto-optical medium such as a floptical disk, and a hardware device such as a ROM, a RAM and a flash memory which is specifically formed to store and execute the program command.

An example of the program command includes a machine language code which is produced by a complier, and a high-level language code which can be executed by a computer using an interpreter or the like. The hardware device may be formed to be operated as one or more software modules and thus to perform the operation of the embodiment and vice versa.

Although a few embodiments of the present embodiment have been shown and described, it would be appreciated by those skilled in the art that changes may be made in these embodiments without departing from the principles and spirit of the embodiment, the scope of which is defined in the claims and their equivalents.

What is claimed is:

1. A cooking apparatus comprising:

a cooking chamber;

an input part configured to receive at least one of a plate warming mode command to warm one or more plates to a first temperature and a food warming mode command to warm food to a different second temperature;

a microwave heating part configured to radiate a microwave to the one or more plates disposed in the cooking chamber in response to receiving the plate warming mode command to warm the one or more plates to the first temperature; and a control part configured to estimate a number of plates disposed in the cooking chamber, and to control at least one of an operation time of the microwave heating part and an intensity of the microwave radiated from the microwave heating part to warm the one or more plates to the first temperature based on the estimated number of plates disposed in the cooking chamber when the plate warming mode command is received.

2. The cooking apparatus according to claim 1, wherein the input part receives a warming degree of the plate disposed in the cooking chamber.

3. The cooking apparatus according to claim 2, wherein the control part warms the plate disposed in the cooking chamber by controlling an operation of the microwave heating part according to the operation time and the intensity of the microwave predetermined corresponding to the warming degree received at the input part.

4. The cooking apparatus according to claim 3, wherein the control part warms the plate disposed in the cooking chamber by controlling the intensity of the microwave to be constant during the operation time, or adjusting the intensity of the microwave.

5. The cooking apparatus according to claim 3, wherein the control part warms the plate disposed in the cooking chamber by adjusting the intensity of the microwave over time, or controlling the intensity of the microwave in a plurality of stages.

6. The cooking apparatus according to claim 1, further comprising a load container which is disposed above the plate disposed in the cooking chamber, and used to warm the plate disposed in the cooking chamber.

7. The cooking apparatus according to claim 6, wherein a liquid substance which is heated by absorbing the microwave radiated from the microwave heating part is accommodated in a body of the load container.

8. The cooking apparatus according to claim 6, wherein a lower surface of the load container is designed to be spaced apart from the plate put under the load container in a predetermined distance.

9. The cooking apparatus according to claim 6, wherein the plate disposed in the cooking chamber is warmed using a liquid substance accommodated in a body of the load container as a load to absorb the microwave.

10. A method for controlling a cooking apparatus having one or more plates disposed in a cooking chamber, comprising:

receiving at least one of a plate warming mode command and a food warming mode command;

estimating a number of the one or more plates disposed in the cooking chamber;

receiving one of a first mode to warm the one or more plates to a first temperature and a second mode to warm the one or more plates to a different second temperature when the plate warming mode command is received; and controlling a radiation of a microwave according to an operation method predetermined corresponding to the one of the first mode and the second mode received, and warming the one or more plates disposed in the cooking chamber to the first temperature or the different second temperature based on the one of the first mode and the second mode received, and the estimated number of plates disposed in the cooking chamber when the plate warming mode command is received.

11. The method according to claim 10, wherein the warming warms the plate disposed in the cooking chamber by controlling the radiation of the microwave according to an operation time and an intensity of the microwave predetermined corresponding to input one of the first mode and the second mode.

12. The method according to claim 10, wherein the warming warms the plate disposed in the cooking chamber by constantly radiating an intensity of the microwave or adjusting the intensity of the microwave during a predetermined period of time.

13. The method according to claim 12, wherein the warming warms the plate disposed in the cooking chamber by adjusting the intensity of the microwave in a plurality of stages over time.

14. The method according to claim 10, wherein the warming warms the plate disposed in the cooking chamber using a load container disposed above the plate disposed in the cooking chamber.

15. The method according to claim 14, wherein a liquid substance which is heated by absorbing the microwave that has been radiated is accommodated in a body of the load container.

16. The method according to claim 14, wherein a lower surface of the load container is designed to be spaced apart from the plate put under the load container in a predetermined distance.

17. The method according to claim 15, wherein the warming warms the plate disposed in the cooking chamber using the liquid substance accommodated in the body of the load container as a load which absorbs the microwave.

* * * * *